US010082145B2

(12) United States Patent
Decker

(10) Patent No.: US 10,082,145 B2
(45) Date of Patent: Sep. 25, 2018

(54) COMPRESSOR WHEEL WITH BALANCE CORRECTION AND POSITIVE PILOTING

(71) Applicant: BorgWarner Inc., Auburn Hills, MI (US)

(72) Inventor: David M. Decker, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 385 days.

(21) Appl. No.: 14/417,866

(22) PCT Filed: Jul. 26, 2013

(86) PCT No.: PCT/US2013/052205
§ 371 (c)(1),
(2) Date: Jan. 28, 2015

(87) PCT Pub. No.: WO2014/025554
PCT Pub. Date: Feb. 13, 2014

(65) Prior Publication Data
US 2015/0252810 A1 Sep. 10, 2015

Related U.S. Application Data

(60) Provisional application No. 61/680,491, filed on Aug. 7, 2012.

(51) Int. Cl.
*F04D 25/04* (2006.01)
*F01D 5/02* (2006.01)
(Continued)

(52) U.S. Cl.
CPC ..... *F04D 25/045* (2013.01); *F01D 5/025* (2013.01); *F04D 29/051* (2013.01);
(Continued)

(58) Field of Classification Search
None
See application file for complete search history.

(56) References Cited

U.S. PATENT DOCUMENTS 2,325,303 A * 7/1943 Brooke ..... B21K 1/707 411/303
4,694,689 A 9/1987 Kawasaki
(Continued)

FOREIGN PATENT DOCUMENTS

CN 1510259 A 7/2004
CN 1869407 A 11/2006
(Continued)

OTHER PUBLICATIONS

Chinese Patent Application No. 201380038136.5, Office Action, 13 pages, dated Jun. 20, 2016.
(Continued)

*Primary Examiner* — John K Fristoe, Jr.
*Assistant Examiner* — Daphne M Barry
(74) *Attorney, Agent, or Firm* — Perkins Coie LLP

(57) ABSTRACT

A turbocharger including, a turbine wheel (10), a shaft (111) attached to the turbine wheel (10), and a compressor wheel (132) disposed on the shaft (111) opposite the turbine wheel (10). The compressor wheel (132) includes a back wall (134) and an axial bore (137) and a pilot washer (150) is located adjacent the compressor wheel back wall (134). The pilot washer (150) has an inner diameter (162) and an outer diameter (160), and includes a conical pilot ring (154) that extends into the axial bore (137) of the compressor wheel (132). The pilot washer (150) includes a slit (164) extending from the inner diameter (162) to the outer diameter (160). A nut (113) is threaded to the shaft (111) and is operative to provide an axial clamping force on the compressor wheel (132), thereby causing the pilot washer (150) to contract
(Continued)

onto the shaft (111) as the pilot ring (154) extends into the bore (137).

5 Claims, 4 Drawing Sheets

(51) Int. Cl.
*F04D 29/05* (2006.01)
*F04D 29/051* (2006.01)

(52) U.S. Cl.
CPC .... *F05D 2220/40* (2013.01); *F05D 2230/642* (2013.01); *F05D 2250/232* (2013.01); *F05D 2260/37* (2013.01); *F05D 2300/50212* (2013.01)

(56) References Cited

U.S. PATENT DOCUMENTS 4,986,733 A * 1/1991 Fleury ..... F01D 5/025 403/361
5,174,733 A 12/1992 Yoshikawa
6,364,634 B1 * 4/2002 Svihla ..... F01D 5/025 417/409
6,418,722 B1 7/2002 Arnold
2004/0115071 A1 6/2004 Billington
2010/0008767 A1 1/2010 Ward et al.
2012/0003093 A1 1/2012 Lischer et al.
2013/0115088 A1 * 5/2013 Castan ..... F04D 29/054 416/204 A

FOREIGN PATENT DOCUMENTS

CN 101460723 A 6/2009
CN 102341579 A 2/2012
KR 1997-0011333 A 3/1997
KR 1020040036656 A 4/2004

OTHER PUBLICATIONS

International Application No. PCT/US2013/052205, International Search Report & Written Opinion, 9 pages, dated Nov. 13, 2013.

* cited by examiner

COMPRESSOR WHEEL WITH BALANCE CORRECTION AND POSITIVE PILOTING

BACKGROUND

Today's internal combustion engines must meet ever-stricter emissions and efficiency standards demanded by consumers and government regulatory agencies. Accordingly, automotive manufacturers and suppliers expend great effort and capital in researching and developing technology to improve the operation of the internal combustion engine. Turbochargers are one area of engine development that is of particular interest.

A turbocharger uses exhaust gas energy, which would normally be wasted, to drive a turbine. The turbine is mounted to a shaft that in turn drives a compressor. The turbine converts the heat and kinetic energy of the exhaust into rotational power that drives the compressor. The objective of a turbocharger is to improve the engine's volumetric efficiency by increasing the density of the air entering the engine. The compressor draws in ambient air and compresses it into the intake manifold and ultimately the cylinders. Thus, a greater mass of air enters the cylinders on each intake stroke.

With reference to FIG. 1, turbochargers use the exhaust flow from the engine exhaust manifold to drive a turbine wheel 10. Once the exhaust gas has passed through the turbine wheel and the turbine wheel has extracted energy from the exhaust gas, the spent exhaust gas exits a turbine housing (not shown). The energy extracted by the turbine wheel is translated to a rotating motion which then drives a compressor wheel 32. The compressor wheel draws air into the turbocharger, compresses this air and delivers it to the intake side of the engine.

The rotating assembly includes an integral turbine wheel 10 and shaft 11. The compressor wheel 32 is mounted to shaft 11. The shaft 11 rotates on a hydrodynamic bearing system 18 which is fed oil, typically supplied by the engine. The oil is delivered via an oil feed port 21 to feed both journal and thrust bearings. The thrust bearing 59 controls the axial position of the rotating assembly relative to the aerodynamic features in the turbine housing and compressor housing. In a manner somewhat similar to that of the journal bearings, the thrust loads are carried typically by ramped hydrodynamic bearings working in conjunction with complementary axially-facing rotating surfaces of a flinger 40. The turbocharger includes a housing 20 with a cavity 33. The thrust bearing 59 and insert 60 are disposed in the cavity and provide an oil drain cavity 35. Once used, the oil drains to the bearing housing and exits through an oil drain 22 fluidly connected to the engine crankcase.

The traditional approach to mounting a compressor wheel to a turbine shaft is by close fit of concentric cylindrical surfaces (wheel bore to shaft outside diameter). A small clearance minimizes the variation or migration of imbalance during operation. Imbalance can cause destructive failure of bearings due to forces generated and vibratory modes excited. In order to help prevent imbalance migration in traditional designs, the fit between the wheel bore and shaft diameter must be maintained at a very tight tolerance. Accordingly, the tolerances on the wheel bore and shaft diameter must also be very tight. It should be noted that these tight tolerances must be maintained over the entire length of the shaft. Tight tolerances result in higher production costs. Furthermore, the tight fit between the wheel bore and shaft diameter makes assembly of the components more difficult, not to mention disassembly. This approach to mounting a compressor wheel to a turbine shaft does not solve the problem of differential mechanical and thermal growth of the wheel relative to the shaft. For an Aluminum wheel piloted on a steel shaft, differential thermal and mechanical growth may be as much as three times the assembly clearance. Thus, adverse imbalance migration is possible in service.

Another traditional approach to mounting a compressor wheel to a turbine shaft includes creating an interference pilot fit to allow for larger manufacturing tolerances and account for differential thermal growth. With cylindrical pilot lands this approach causes assembly issues. Wheels must be heated or driven onto the shaft by force. The length of the pilot land can make small amounts of runout of the shaft or bore critical. Should the resulting assembly not pass a core balance check, removal of the wheel for re-indexing could result in damage to both the wheel and shaft. For example, turbine wheel materials, such as Titanium, are prone to galling and can seize prior to fully seating. In such cases, scrap costs are very high.

Mounting a compressor wheel to a turbine shaft is further complicated by the need to balance the compressor wheel. Compressor wheel balance correction is traditionally accomplished by metal removal in two planes. The aft plane is corrected by removal of material from the perimeter of the compressor wheel back wall. Scalloping between blades or machining a step pocket in the back wall are two methods used. This material removal is extremely critical to the lifetime of the part as the correction zone can be highly stressed. Thus, removal can have an adverse affect on fatigue life.

The forward correction plane is the nose of the wheel. It is lightly stressed so it can be cut away without significant detriment to function. The essential problem is producing enough back wall correction to minimize scrap without inducing premature failure.

Accordingly, there is a need for structures and methods for accurately piloting a compressor wheel onto a shaft, without the cost of extreme precision machining or the assembly drawbacks of an interference fit. There is a still further need for a design that simplifies balancing a compressor wheel without compromising the fatigue strength of the wheel.

SUMMARY

Provided herein is a turbocharger including, a turbine wheel, a shaft attached to the turbine wheel, and a compressor wheel disposed on the shaft opposite the turbine wheel. The compressor wheel includes a back wall and an axial bore. A pilot washer is located adjacent the compressor wheel back wall. The pilot washer has an inner diameter and an outer diameter, and includes a conical pilot ring that extends into the axial bore of the compressor wheel. The turbocharger may include a second pilot washer located adjacent a nose end of the compressor wheel.

In certain aspects of the technology described herein, the compressor wheel includes a countersink sized and configured to receive the conical pilot ring. The pilot washer may include a slit extending from the inner diameter to the outer diameter. A nut is threaded to the shaft and is operative to provide an axial clamping force on the compressor wheel, thereby causing the pilot washer to contract onto the shaft as the pilot ring extends into the bore. The compressor wheel may be clamped between the nut and a shoulder disposed on the shaft.

The pilot washer may further include a stub ring extending from the pilot ring, wherein the stub ring is pressed into the axial bore. In addition, the compressor wheel and pilot washer may include cooperative indexing features.

Also provided herein is a turbocharger including a turbine wheel, a shaft attached to the turbine wheel, and a compressor wheel disposed on the shaft opposite the turbine wheel. The shaft includes a pilot land and the compressor wheel includes an axial bore sized to provide an interference press fit between the pilot land and axial bore.

In other aspects of the technology described herein, the pilot land is rounded in shape. The turbocharger may further comprise a pilot insert located adjacent a nose end of the compressor wheel. The compressor wheel includes a counter bore sized and configured to receive the pilot insert therein. The pilot insert includes an inner diameter, an outer diameter, and a slit extending from the inner diameter to the outer diameter. A nut is threaded to the shaft and provides an axial clamping force on the compressor wheel, thereby causing the pilot insert to contract onto the shaft as the pilot insert is pushed into the counter bore.

Also contemplated here in is a method of assembling a compressor wheel onto a shaft. In an embodiment, the method comprises determining an imbalance of a compressor wheel, positioning a washer on the shaft, wherein the washer has a non-uniform weight distribution, and positioning the compressor wheel on the shaft, adjacent the washer. The washer is rotated relative to the compressor wheel such that the non-uniform weight distribution of the washer compensates for the imbalance. The position of the washer with respect to the compressor wheel is maintained by clamping, for example. The method may further comprise removing material from the washer.

In other aspects of the technology described herein, the compressor wheel includes an axial bore and the washer includes a conical pilot ring extending into the axial bore. The washer includes an inner diameter, an outer diameter, and a slit extending from the inner diameter to the outer diameter. The method further comprises clamping the compressor wheel and washer together, thereby causing the pilot washer to contract onto the shaft as the pilot ring extends into the bore.

These and other aspects of the disclosed technology will be apparent after consideration of the Detailed Description and Figures herein. It is to be understood, however, that the scope of the invention shall be determined by the claims as issued and not by whether given subject matter addresses any or all issues noted in the background or includes any features or aspects recited in this summary.

DRAWINGS

Non-limiting and non-exhaustive embodiments of the disclosed technology, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense. It should be understood that not all of the components of a turbocharger are shown in the figures and that the present disclosure contemplates the use of various turbocharger components as are known in the art. Turbocharger construction is well understood in the art and a full description of every component of a turbocharger is not necessary to understand the technology of the present application, which is fully described and disclosed herein.

Figure 1:
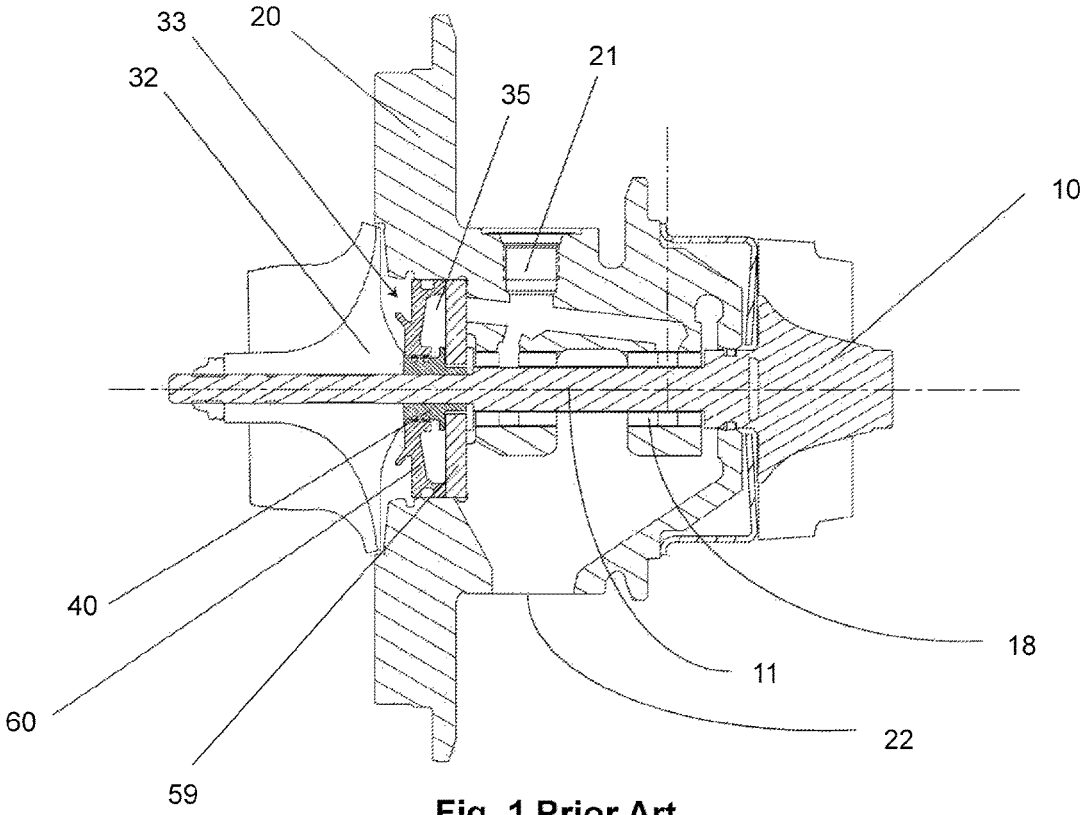
Fig. 1 Prior Art
FIG. 1 is a side view in cross-section of a typical turbocharger.
Figure 2:
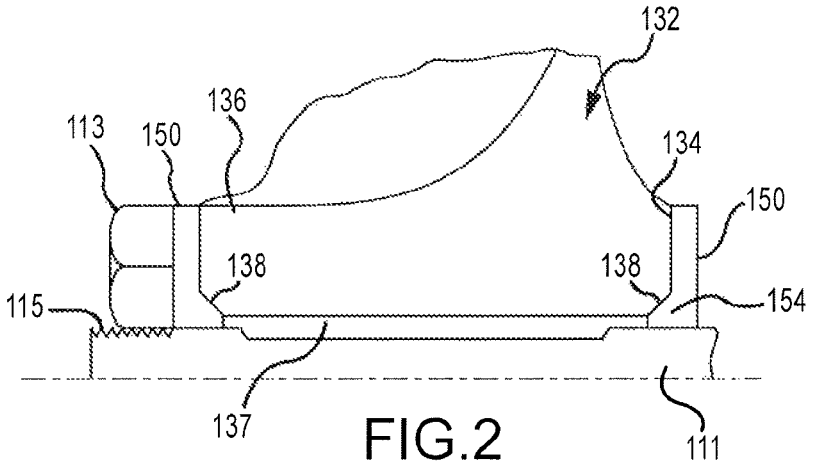
FIG. 2 is a partial side view in cross-section illustrating a compressor wheel with balance correction and positive piloting according to a first exemplary embodiment.

FIG. 2 illustrates a compressor wheel with balance correction and positive piloting features according to a first exemplary embodiment. Compressor wheel 132 includes a back wall 134 and a nose end 136. Compressor wheel 132 also includes an axial bore 137 which receives shaft 111. A pilot washer 150 is located adjacent the back wall 134 and includes a conical pilot ring 154, which extends into the axial bore 137. The compressor wheel 132 may include a counter sink 138 that is sized and configured to receive the conical pilot ring 154. The compressor wheel 132 may also be mounted to the shaft 111 with a second pilot washer 150 located at the nose end 136 of the compressor wheel. A nut 113 is attached to the shaft 111 by threads 115. The nut is operative to provide an axial clamping force on the compressor wheel 132, thereby causing the pilot washer 150 to contract onto the shaft 111 as the pilot ring 154 extends into the bore 137. Because the pilot washer is slit the axial loading causes circumferential contraction such that the washer contracts to engage the shaft, thereby creating a rigid pilot. This arrangement provides positive piloting regardless of variation in bore and shaft sizes. This arrangement also helps prevent balance migration as long as the clamp load is maintained. Tolerancing can be more generous and the manufacturing processes more robust. Assembly is much easier with more clearance prior to clamping.

Figure 3:
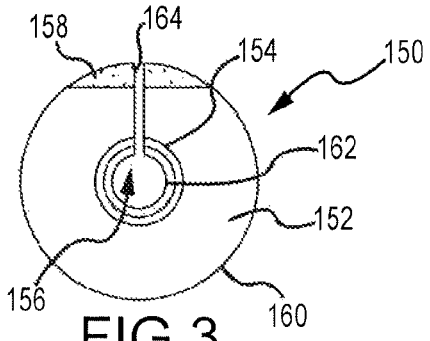
FIG. 3 is a top plan view of a pilot washer as shown in FIG. 2.

With reference to FIG. 3, it can be appreciated that pilot washer 150 includes a washer portion 152 and a conical pilot ring 154 extending axially therefrom. The pilot washer 150 has an inner diameter 162 and an outer diameter 160 with a slit 164 extending between the inner and outer diameters. Accordingly, the pilot washer 150 includes an aperture 156 defined by the inner diameter 162. As mentioned above, the pilot washer 150 contracts to clamp against shaft 111 as a result of the conical pilot ring 154 being forced into the axial bore 137 of the compressor wheel 132. Accordingly, as the pilot ring 154 is forced into the axial bore 137, the aperture 156 contracts and slit 164 narrows.

It can be appreciated from the figure that slit 164 causes the pilot washer 150 to have a non-uniform weight distribution which may be used to compensate for compressor wheel imbalance. Also shown in FIG. 3 is a material removal region 158. Material may be removed from this region in order to further compensate for imbalance in the compressor wheel 132. Accordingly, the pilot washer may be rotationally positioned with respect to the compressor wheel 132 in order to help compensate for any imbalance in the compressor wheel 132. In this case, the pilot washer is comprised of steel, which is approximately three times the density of Aluminum and approximately twice the density of Titanium.

Figure 4:
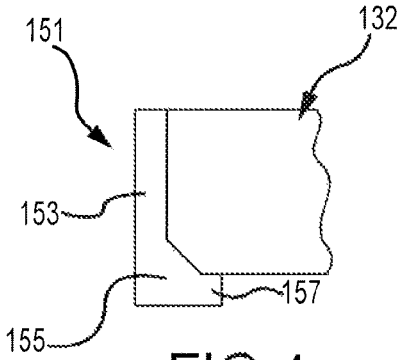
FIG. 4 is a partial side view in cross-section illustrating an alternative construction of the pilot washer.

FIG. 4 illustrates an alternative construction of a pilot washer 151. In this case, pilot washer 151 includes a washer portion 153 with a conical pilot ring 155 similar to that described above with respect to FIG. 3. However, in this case, the pilot washer 151 also includes a stub ring 157 extending from the conical pilot ring 155 in an axial direction. The stub ring 157 may be pressed into the axial bore 137 of the compressor wheel 132. Thus, the pilot washer 151 is conveniently maintained in position during assembly operations.

Figure 5:
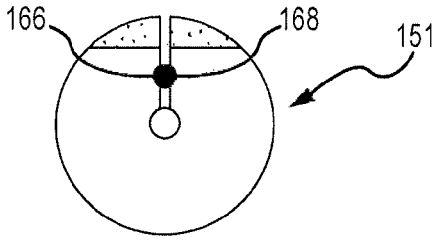
FIG. 5 is a bottom plan view of a pilot washer illustrating cooperative indexing features of the compressor wheel and pilot washer.
Figure 6:
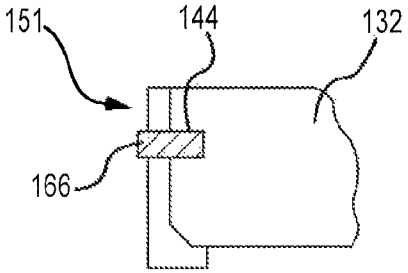
FIG. 6 is a partial side view in cross-section of the pilot washer shown in FIG. 5.

As shown in FIGS. 5 and 6, the compressor wheel and pilot washers may include cooperative indexing features. For example, in this case, the cooperative indexing features are in the form of a dowel pin 166, which is pressed into a dowel pin hole 144 formed in the compressor wheel 132. The pilot washer 151 may also include an enlarged region 168 along slit 164 that is sized to accommodate the dowel pin 166 as shown.

Figure 7:
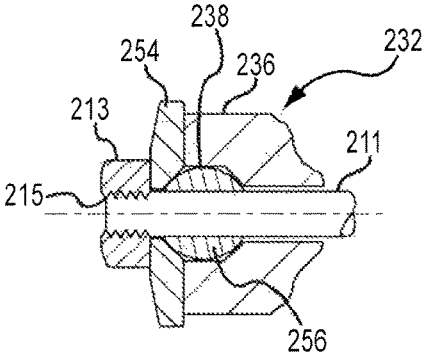
FIG. 7 is a partial side view in cross-section illustrating the nose end of a compressor wheel with positive piloting according to a second exemplary embodiment.
Figure 8:
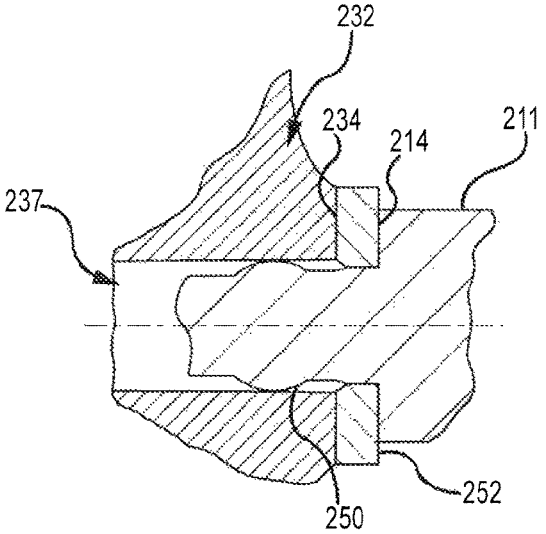
FIG. 8 is a partial side view in cross-section illustrating the back wall portion of the compressor wheel with positive piloting shown in FIG. 7.

FIGS. 7 and 8 illustrate a compressor wheel with positive piloting according to a second exemplary embodiment. In this case, the compressor wheel 232 has a back wall 234 which abuts a shoulder 214 formed on shaft 211. The assembly may also include a shoulder washer 252, which may be used for balancing compensation by removing material from the washer. In this case, shaft 211 includes a pilot land 250, which is sized to provide an interference press fit between the axial bore 237 of compressor wheel 232 and the pilot land 250. In this case, pilot land 250 is rounded or spherical in shape. Accordingly, the tolerances for the axial bore and pilot land may be relaxed when compared to traditional press fit and/or clearance fit applications.

The interference fit accounts for both manufacturing tolerance and relative thermal and mechanical growth between the wheel and shaft. Further, this arrangement helps eliminate the potential for balance migration inherent with a clearance fit approach. Tight tolerances only need to be maintained on localized features, not an entire bore or shaft length. Runout tolerances are not needed. Lower cost manufacture is therefore possible. The press fit can also be tailored to the material. Since Titanium has less thermal expansion than steel, the press fit can be reduced, further reducing risk of damage.

With specific reference to FIG. 7, the compressor wheel assembly may also include a pilot insert 256, which is pressed into a counter bore 238 that is formed in the nose end 236 of the compressor wheel 232. As nut 213 is threaded on the threads 215, it provides an axial clamping force against clamping washer 254, which in turn presses the pilot insert 256 into the counter bore 238. Pilot insert 256 may be split (in a similar fashion to the pilot washer described above) so that as it is forced into counter bore 238 it contracts onto shaft 211, thereby providing a positive pilot for the nose end of the compressor wheel 232. Here again, the clamping washer 254 may provide compensation for imbalance in the compressor wheel by removing material.

Methods relating to the above described compressor wheel with balance correction and positive piloting are also contemplated. The methods thus encompass the steps inherent in the above described structures and assembly thereof. In an exemplary embodiment, the method may comprise determining an imbalance of a compressor wheel, positioning a washer on the shaft, wherein the washer has a non-uniform weight distribution, and positioning the compressor wheel on the shaft, adjacent the washer. The washer is rotated relative to the compressor wheel such that the non-uniform weight distribution of the washer compensates for the imbalance. The position of the washer with respect to the compressor wheel is maintained by clamping, for example. The method may further comprise removing material from the washer.

Accordingly, the compressor wheel with balance correction and positive piloting has been described with some degree of particularity directed to the exemplary embodiments. It should be appreciated, however, that the present invention is defined by the following claims construed in light of the prior art so that modifications or changes may be made to the exemplary embodiments without departing from the inventive concepts contained herein.

What is claimed is:

1. A turbocharger, comprising:

a turbine wheel (232);

a shaft (211) attached to the turbine wheel (10) and including a spherical pilot land (250);

a compressor wheel (232) disposed on the shaft (211) opposite the turbine wheel (10), wherein the compressor wheel (232) includes an axial bore (237) sized to provide an interference press fit between the pilot land (250) and axial bore (237);

a pilot insert (256) positioned on the shaft adjacent a nose end (236) of the compressor wheel (232); and a clamping washer (254) circumscribing the shaft (211) and located adjacent the pilot insert (256).

2. The turbocharger according to claim 1, further comprising a nut (213) threaded to the shaft (211) and operative to provide an axial clamping force on the compressor wheel (232).

3. The turbocharger according to claim 2, wherein the compressor wheel (232) is clamped between the nut (213) and a shoulder (214) disposed on the shaft (211).

4. The turbocharger according to claim 1, wherein the compressor wheel (232) includes a counter bore (238) concentric with the axial bore and sized and configured to receive the pilot insert (256) therein.

5. A turbocharger, comprising:

a turbine wheel (232);

a shaft (211) attached to the turbine wheel (10) and including a pilot land (250);

a compressor wheel (232) disposed on the shaft (211) opposite the turbine wheel (10), wherein the compressor wheel (232) includes:

an axial bore (237) sized to provide an interference press fit between the pilot land (250) and the axial bore (237); and a counter bore (238) concentric with the axial bore (237);

a pilot insert (256) positioned on the shaft (211) and in the counter bore (238); and a clamping washer (254) circumscribing the shaft (211) and located adjacent the pilot insert (256).

* * * * *